United States Patent [19]

Scozzafava et al.

[11] Patent Number: 4,485,161

[45] Date of Patent: Nov. 27, 1984

[54] ELECTROPHOTOGRAPHIC ELEMENTS HAVING BARRIER LAYERS OF CROSSLINKED POLYMERS OF ALIPHATIC OR AROMATIC MONOMERS CONTAINING α,β-ETHYLENICALLY UNSATURATED CARBONYL-CONTAINING SUBSTITUENTS

[75] Inventors: Michael Scozzafava; Michel F. Molaire, both of Rochester, N.Y.

[73] Assignee: Eastman Kodak Company, Rochester, N.Y.

[21] Appl. No.: 506,247

[22] Filed: Jun. 20, 1983

[51] Int. Cl.[3] ..... G03G 5/14

[52] U.S. Cl. ..... 430/64; 430/60

[58] Field of Search ..... 430/60, 64

[56] References Cited

U.S. PATENT DOCUMENTS

| | | | |
|---|---|---|---|
| 3,573,906 | 4/1971 | Goffe | 96/1.8 |
| 3,932,179 | 1/1976 | Perez-Albuerne | 96/1.5 |

FOREIGN PATENT DOCUMENTS

| | | | |
|---|---|---|---|
| 49-16065 | 4/1974 | Japan | 430/60 |
| 51-8334 | 3/1976 | Japan | 430/60 |
| 57-89760 | 6/1982 | Japan | 430/64 |

OTHER PUBLICATIONS

Research Disclosure, Jul. 1981, Item 20710.

*Primary Examiner*—Roland E. Martin
*Attorney, Agent, or Firm*—John R. Everett

[57] ABSTRACT

An electrophotographic element comprising a conductive layer, a photoconductive layer and a barrier layer between the conductive layer and the photoconductive layer characterized in that the barrier layer comprises a polymerized crosslinked monomer having an aliphatic or aromatic group comprising at least one α, β-ethylenically unsaturated carbonyl-containing substituent is disclosed.

4 Claims, No Drawings

ELECTROPHOTOGRAPHIC ELEMENTS HAVING BARRIER LAYERS OF CROSSLINKED POLYMERS OF ALIPHATIC OR AROMATIC MONOMERS CONTAINING α,β-ETHYLENICALLY UNSATURATED CARBONYL-CONTAINING SUBSTITUENTS

FIELD OF THE INVENTION

This invention relates to electrophotographic elements which include a barrier layer between an electrically conductive layer and a photoconductive layer. More specifically, this invention relates to the use of polymerized crosslinked aliphatic or aromatic group having α,β-ethylenically unsaturated carbonyl substituents as barrier layers for electrophotographic elements.

BACKGROUND OF THE INVENTION

Electrophotographic imaging elements, processes and techniques have been extensively described in both the patent and other literature. Generally, electrophotographic processes employ an electrophotographic element which responds to imagewise exposure with electromagnetic radiation by forming a latent electrostatic charge image. A variety of subsequent operations, now well known in the art can then be employed to produce a permanent record of the image.

One type of electrophotographic element particularly useful in electrophotographic processes comprises a multi-layer structure. Such an element is prepared by coating a layer of a photoconductive composition onto a film support previously overcoated with a layer of conducting material. In addition, an insulating or barrier layer is interposed between the conducting layer and the photoconductive layer.

The barrier layer serves a variety of functions in electrophotographic elements. It primarily reduces the charge leakage of an electrophotographic element in the absence of activating radiation. The latter phenomenon is generally referred to as "dark decay".

For electrophotographic microimaging applications or for very high quality one to one electrophotographic reproductions, it is important for the photoconductive layer to resist localized dielectric breakdown. Dielectric breakdown in a photoconductive layer results in small, discrete areas on the surface of the layer, about 5 to 30 μm across, which appear light struck (white spots). Such discrete areas are unable to hold a surface charge. Most photoconductive layers having a high photodischarge sensitivity suffer from an excessively high density of dielectric breakdown spots.

Previously disclosed barrier layers for electrophotographic elements include aluminum oxide, polystyrene and cellulose nitrate. The problem is that these barrier layers have not been successful in minimizing the density of dielectric breakdown spots in high speed, highly sensitive photoconductive layers intended for microimaging or high quality electrophotographic reproduction.

SUMMARY OF THE INVENTION

The present invention provides an electrophotographic element comprising a conductive layer, a photoconductive layer and a barrier layer between the conductive layer and the photoconductive layer characterized in that the barrier layer comprises a polymerized crosslinked monomer having one or more aliphatic or aromatic groups containing at least one α,β-ethylenically unsaturated carbonyl group-containing substituent. In a preferred embodiment the electrophotographic elements of the invention include a barrier layer comprising a polymerized crosslinked aliphatic or aromatic group having at least one acrylate or methacrylate carbonyl substituent.

The barrier layer of the electrophotographic elements of the present invention results in electrophotographic elements having a high photodischarge sensitivity, low dark charge decay and a low density of dielectric breakdown spots. Moreover, the barrier layer is insoluble in the common organic solvents such as dichloromethane and toluene used to coat the layer and used to coat the photoconductive and other layers of electrophotographic elements and is not affected by these solvents.

"Aliphatic" refers to mono-, di-, tri- and tetravalent alkanes, alkenes, alkadienes and alkynes having from 1 to 20 carbon atoms. The groups are cyclic, straight or branched chain and include carbohydrate, carboxylic acid, alcohol, ether aldehyde or ketone functions. Cycloaliphatics also include two or more cycloaliphatic groups fused together or bonded together through alkylene groups such as isopropylene and isobutylene.

"Aromatic" refers to mono-, di-, tri- and tetravalent groups which undergo the same type of substitution reaction as benzene. In benzene, substitution reactions are preferred over addition reactions. Such groups preferably have from 6 to about 40 nuclear atoms are mono- and polycyclic. Examples of aromatic groups include phenyl, naphthyl, bisphenyl, anthryl and their di-, tri- and tetravalent counterparts. Such aromatic groups also include two or more aromatic rings fused together such as naphthyl and anthryl or two or more aromatic rings bonded together through alkylene groups such as isopropylene and isobutylene.

"Alkyl" refers to substituted or unsubstituted, monovalent aliphatic groups such as straight or branched chain saturated hydrocarbons having from 1 to about 12 carbon atoms such as methyl, propyl, ethyl, octyl, nonyl and neopentyl. Alkylene refers to the divalent counterparts of alkyl. Cycloalkyl refers to cyclic alkyl groups.

DETAILED DESCRIPTION OF THE INVENTION

As stated hereinbefore, the electrophotographic element of the present invention comprises a conductive layer, a photoconductive layer and a barrier layer between the conductive layer and the photoconductive layer. All three layers can be coated by a variety of known coating techniques such as spray coating, swirl coating, vacuum deposition, extrusion hopper coating, hand coating and air knife coating. The conductive layer is usually coated on a support. After allowing time for drying, the barrier layer is produced by coating the polymerizable and crosslinkable monomer from a solvent. After removal of the solvent, the monomer film is crosslinked using radiant energy. The photoconductive layer is then coated over the barrier layer.

The barrier layer is conveniently coated from a coating composition comprising the selected monomer having an aromatic or aliphatic group containing the α,β-ethylenically unsaturated carbonyl compound, and preferably a photoinitiator composition, dissolved in a solvent such as dichloromethane, 2-ethoxyethanol, toluene, heptane and other suitable solvents. The solvent is allowed to evaporate and the α, β-ethylenically unsaturated carbonyl substituted aliphatic or aromatic group is polymerized and crosslinked by irradiation with radiant energy such as UV light. In some circumstances it is possible to induce polymerization and crosslinking of the $\alpha,\beta$-ethylenically unsaturated carbonyl substituted aliphatic and aromatic group with heat or using E beam energy without the use of a photoinitiator composition. It is also possible to coat the polymerizable crosslinkable monomer without a solvent, using techniques such as gravure printing. Temperatures in the range of from 40° to 120° C. are useful in promoting polymerization and crosslinking of the monomer.

It may be desirable to add a limited amount of an electrically insulating polymer binder to the barrier layer coating composition. For example, the coating compositions may have little viscosity, and thus in some instances, coating difficulties. We have found that electrically insulating polymers can be added to the coating composition to increase viscosity and facilitate coating, without detrimentally effecting the electrical properties of the coated layer. However, the amount of polymer added should preferably be less than 20% of the monomer-polymer combined weight, more preferably less than 10%, to minimize solvent preparation of the coated barrier layer. Such insulating polymers are well known in electrophotography.

Useful $\alpha,\beta$-ethenically unsaturated monomers are derived from:

1. polyfunctional aromatic or aliphatic acids such as 1,3,5-benzenetricarboxylic acid, 1,4-benzenedicarboxylic acid, 1,3-benzenedicarboxylic acid, 1,3-naphthalenecarboxylic acid, 1,2,4-benzenetricarboxylic acid, 1,2-benzenedicarboxylic acid, 1,2,3-benzenetricarboxylic acid, 1,2,4,5-benzenetetracarboxylic acid, 1,2,3,5-benzenetetracarboxylic acid, 1,4-cyclohexanedicarboxylic acid, 1,3-cyclohexanedicarboxylic acid, 1,3,5-cyclohexanetricarboxylic acid, 1,2-cyclohexanedicarboxylic acid, 1,2,4-cyclohexanetricarboxylic acid, 1,2,3-cyclohexanetricarboxylic acid, 1,2,4,5-cyclohexanetetracarboxylic acid, 1,2,3,5-cyclohexanetetracarboxylic acid, 1,2,4,5-cyclohexanetetracarboxylic acid and their derivatives.
2. polyfunctional aromatic or aliphatic alcohols such as 1,2,3-benzenetriol, 1,2,4-benzenetriol, 1,3,5-benzenetriol, 1,2-benzenediol, 1,3-benzenediol, 1,4-benzenediol, 1,2,3-cyclohexanetriol, 1,2,4-cyclohexanetriol, 1,3,5-cyclohexanetriol, 1,2-cyclohexanediol, 1,4-cyclohexanediol.
3. polyfunctional polynuclear aromatic or aliphatic alcohols such as hydrogenated bisphenol A, bisphenols with long chain bridges such as butylene, heptylene, hexylene, octadecylene and the like.
4. polyfunctional polynuclear aromatic or aliphatic acids such as phenylindanedicarboxylic acid, hydrogenated phenylindanedicarboxylic acid, 4,4'-isopropylidenedibenzoic acid, 4,4'-isopropylidenedicyclohexanoic acid.
5. and other polymerizable crosslinkable monomers that can be coated with or without a solvent and crosslinked to yield an insoluble film with suitable electrical properties for use as a barrier layer.

The polymerizable crosslinkable monomers prepared from the above polyfunctional nuclei, can be mixed in certain proportion with monofunctional polymerizable monomers to control certain physical properties such as viscosity, flexibility, curing speed and adhesion.

Useful $\alpha,\beta$-ethylenically unsaturated monofunctional monomers include benzoyloxyethyl acrylate, benzoyloxypropyl acrylate, benzoyloxypentyl acrylate, benzoyloxybutyl acrylate, benzoyloxyhexyl acrylate, benzoyloxyethyl methacrylate, benzoyloxypropyl methacrylate, benzoyloxybutyl methacrylate, benzoyloxypentyl methacrylate and benzoyloxyhexyl methacrylate, phenyl acrylate, phenyl methacrylate, cyclohexyl acrylate, cyclohexyl methacrylate, cyclohexyloyloxethyl acrylate, cyclohexyloyloxypropyl acrylate, cyclohexyloyloxyhexyl acrylate and combinations of these monomers.

The monomers are made according to the procedure of U.S. Pat. No. 4,322,490 granted Mar. 30, 1982 to Molaire.

Any photoinitiator composition is useful in this invention. A mixture of Michler's ketone and benzophenone is useful. Other compositions comprising an amine activator and a 3-ketocoumarin photosensitizer are described in *Research Disclosure,* December 1980, Item 20036 entitled "Photopolymerizable Compositions Featuring Novel Co-Initiator". The amount of the photoinitiator composition does not appear to be critical. Amounts between about 0.0002 and 0.2 mmole/gm of dry solids content are effective. Preferred amounts extend from about 0.001 to about 0.01 mmole/gm.

The following is a list of representative coumarin photosensitizers highly useful as one of the components of the photoinitiator composition:

3-(2-benzofuroyl)-7-diethylaminocoumarin;
3-(2-benzofuroyl)-7-(1-pyrrolidinyl)coumarin;
3-benzoyl-7-diethylaminocoumarin;
3-(o-methoxybenzoyl)-7-diethylaminocoumarin;
3-(p-dimethylaminobenzoyl)-7-diethylaminocoumarin;
3,3'-carbonylbis(5,7-di-n-propoxycoumarin;
3,3'-carbonylbis(7-diethylaminocoumarin);
3-benzoyl-7-methoxycoumarin;
7-diethylamino-3-[3-(2-thienyl)acryloyl]coumarin;
3-(2-furoyl)-7-diethylaminocoumarin;
3-(p-diethylaminocinnamoyl)-7-diethylaminocoumarin;
7-methoxy-3-(3-pyridylcarbonyl)coumarin and
3-benzoyl-5,7-dipropoxycoumarin.

Representative useful amine activators above include ethyl p-dimethylaminobenzoate; other esters of p-dimethylaminobenzoic acid, e.g., n-butyl p-dimethylaminobenzoate, phenethyl p-dimethylaminobenzoate, 2-phthalimidoethyl p-dimethylaminobenzoate, 2-methacryloyloxyethyl p-dimethylaminobenzoate, pentamethylenebis(p-dimethylamino)benzoate; 4,4'-bis(-dimethylamino)benzophenone; phenethyl and pentamethylene esters of m-dimethylaminobenzoic acid; p-dimethylaminobenzaldehyde; 2-chloro-4-dimethylaminobenzaldehyde; p-dimethylaminoacetophenone; p-dimethylaminobenzyl alcohol; ethyl (p-dimethylamino)benzoyl acetate; p-N-piperidinoacetophenone; 4-dimethylaminobenzoin; N,N-dimethyl-p-toluidine; N,N-diethyl-m-phenetidine; tribenzylamine; dibenzylphenylamine; N-methyl-N-phenylbenzylamine; p-bromo-N,N-dimethylaniline; tridodecylamine; and 4,4',4''-methylidynetris(N,N-dimethylaniline) (crystal violet, leuco base).

Particularly useful monomers having $\alpha,\beta$-ethylenically unsaturated carbonyl-containing substituents have the formula

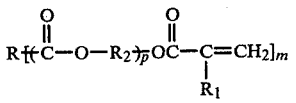
wherein
R represents a cycloaliphatic or an aromatic group;
$R_1$ represents hydrogen or alkyl;
$R_2$ represents alkylene of 1 to 20 carbon atoms, or $-CH_2CH_2(OCH_2CH_2)n$;
p is 0 or 1; and
n is 1 to 20;
m is 1 to 6.
Representative examples of such monomers are presented below.
TABLE I
1.
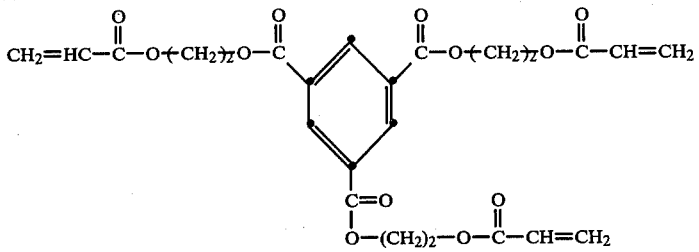
2.
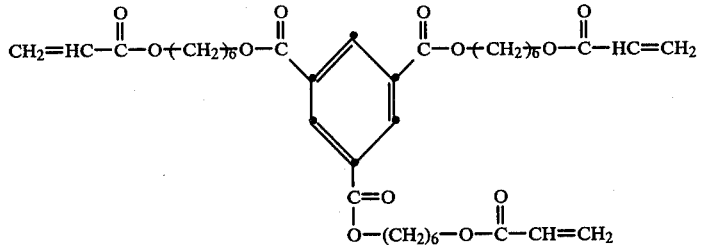
3.
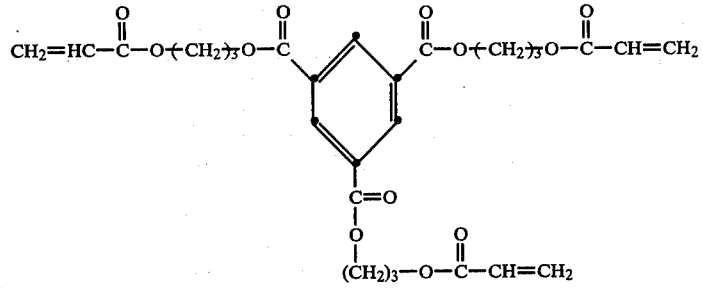
4.
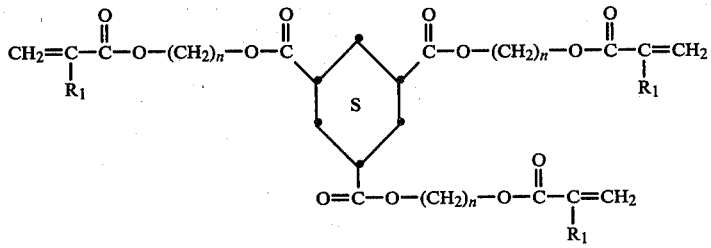
$R_1$ = H, $CH_3$;
n = one to 6.
5.
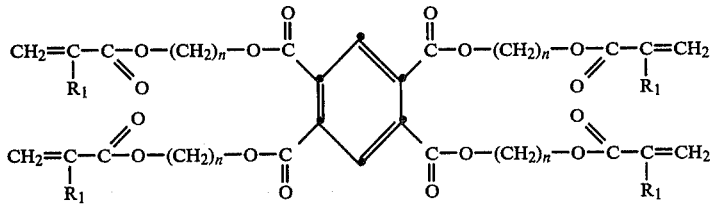
$R_1$= H, $CH_3$;
n = one to 6.

TABLE I-continued

6.

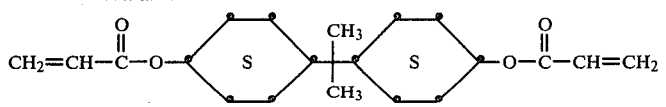

7.

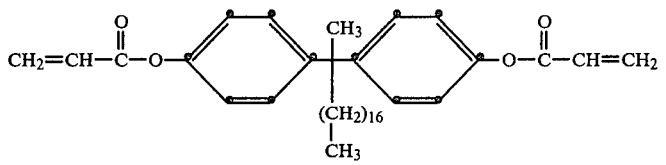

8.

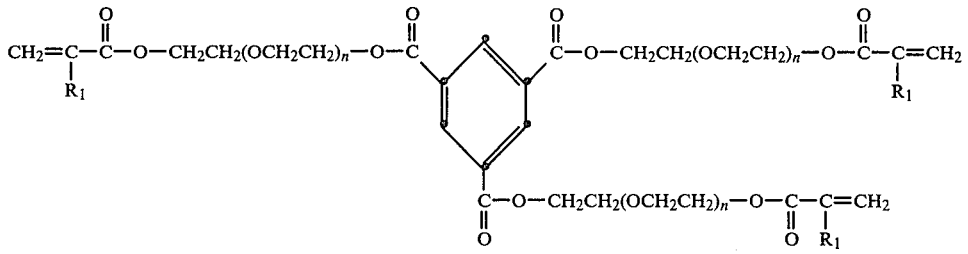

$R_1$ = H, $CH_3$;
n = 1 to 10.

The electrophotographic elements of the invention can include a variety of electrically conducting supports, such as mutual supports, cellulose acetate, cellulose nitrate, polystyrene, poly(ethylene terephthalate), poly(vinyl acetal), polycarbonate and related films having a conductive surface thereon. Useful conducting supports are described in U.S. Pat. No. 3,597,272; and optimum preparation and use are disclosed in U.S. Pat. No. 3,007,901; U.S. Pat. No. 3,245,833; and U.S. Pat. No. 3,262,807, etc.

Photoconductive layers for the electrophotographic elements are prepared with a variety of organic photoconductive compounds and sensitizing compounds by blending a dispersion or solution of the photoconductive compound together with an electrically insulating, film-forming resin binder when necessary or desirable and coating or forming a self-supporting layer with the photoconductive composition.

Generally, a suitable amount of the sensitizing compound is mixed with the photoconductive coating composition so that after thorough mixing, the sensitizing compound is uniformly distributed throughout the desired layer of the coated element. Methods and means for making electrophotographic elements are well known in the art.

Useful photoconductive compounds include the following:

A. Inorganic photoconductors such as zinc oxide, zinc sulfide, cadmium selenide, zinc silicate, cadmium sulfide, arsenic triselenide, antimony trisulfide, lead oxide, titanium dioxide, others as listed, for example, in Middleton et al U.S. Pat. No. 3,121,006, issued Feb. 11, 1964; and selenium;

B. Arylamine photoconductors including substituted and unsubstituted arylamines, diarylamines, nonpolymeric triarylamines and polymeric triarylamines such as those described in Fox U.S. Pat. No. 3,240,597, issued Mar. 15, 1966 and Klupfel et al U.S. Pat. No. 3,180,730, issued Apr. 27, 1965;

C. Polyarylalkane photoconductors of the types described in Noe et al U.S. Pat. No. 3,274,000, issued Sept. 20, 1966, Wilson U.S. Pat. No. 3,542,547, issued Nov. 24, 1970 and in Seus et al U.S. Pat. No. 3,542,544, issued Nov. 24, 1970;

D. 4-Diarylamino-substituted chalcones of the types described in Fox U.S. Pat. No. 3,526,501, issued Sept. 1, 1970;

E. Non-ionic cycloheptenyl compounds of the types described in Looker U.S. Pat. No. 3,533,786, issued Oct. 13, 1970;

F. Compounds containing an N-N nucleus, as described in Fox U.S. Pat. No. 3,542,546, issued Nov. 24, 1970;

G. Organic compounds having a 3,3'-bis-aryl-2-pyrazoline nucleus, as described in Fox et al U.S. Pat. No. 3,527,602, issued Sept. 8, 1970;

H. Triarylamines in which at least one of the aryl radicals is substituted by either a vinyl radical or a vinylene radical having at least one active hydrogen-containing group, as described in Brantly et al U.S. Pat. No. 3,567,450, issued Mar. 2, 1971;

I. Triarylamines in which at least one of the aryl radicals is substituted by an active hydrogen-containing group, as described in Brantly et al Belgian Pat. No. 728,563, dated Apr. 30, 1960;

J. Organo-metallic compounds having at least one aminoaryl substituent attached to a Group IVa or Group Va metal atom, as described in Goldman et al Canadian Pat. No. 818,539, dated July 22, 1969;

K. Organo-metallic compounds having at least one aminoaryl substituent attached to a Group IIIa metal atom, as described in Johnson Belgian Pat. No. 735,334, dated Aug. 29, 1969;

L. Charge transfer combinations, e.g., those comprising a photoconductor and a Lewis acid, as well as photoconductive compositions involving complexes of non-photoconductive material and a Lewis acid, such as described, for example, in Jones U.S. Defensive Publication No. T881,002, dated Dec. 1, 1970 and Mammino U.S. Pat. Nos. 3,408,181 through 3,408,190, all dated Oct. 29, 1968 and Inami et al U.S. Pat. No. 3,418,116, dated Dec. 24, 1968.

The binder materials useful in forming photoconductive compositions include a wide variety of well known film-forming resinous materials described in the electrophotographic art.

The elements of the present invention can be employed in any of the well-known electrophotographic processes. In these processes, an electrophotographic element is held in the dark and given a blanket electrostatic charge by placing it under a corona discharge. The electrostatic charge formed on the surface of the photoconductive layer is then selectively dissipated from the surface of the layer by image-wise exposure to light by conventional exposure means to form a latent electrostatic image in the photoconductive layer.

The charge pattern produced by exposure is then developed or transferred to another surface and developed there by treatment with a toner comprising electrostatically responsive particles having optical density.

The process of preparing electrophotographic elements of the invention comprising the novel barrier layer is shown in the following examples and comparative example.

In the examples, the "dark decay" is measured by an electrometer probe placed near the surface of the film immediately after the corona charge and following the voltage decay in the dark.

The photodischarge sensitivity was determined by charging the electrophotographic element electrostatically under a corona source until the surface potential, as measured by an electrometer probe, reaches some initial voltage Vo. The charged element is then exposed to a 3,000° K. tungsten light source through a gray scale. The exposure causes reduction of the surface potential of the element under each step of the gray scale from its initial potential, Vo, to some lower potential, V, the exact value by which depends on the actual amount of exposure received by the element.

EXAMPLE 1

Control

A photoconductor solution was prepared by dissolving (0.105 gm of 4-[(2,6-diphenyl-4H-thiopyran-4-ylidene)methyl]-2,6-diphenyl thiopyrylium perchlorate in a mixture of 21.1 ml of dichloromethane and 0.8 ml of hexafluoroisopropanol by stirring for one hour. At this time, 1.57 gm of tri-p-tolylamine and 2.50 gm of Lexan 145 polycarbonate (General Electric Company) was added to the above solution. After stirring for 10 minutes, 7.7 ml of toluene was added. This solution was hand coated onto an insulating polyester support which had previously been coated with a conductive layer of cuprous iodide using a 150 μm coating knife and providing a 10 μm thick layer of photoconductor upon drying.

The density of the "dielectric breakdown" spots was measured by placing the imaged film in a Kodak Ektalite 120 Reader which magnifies the image 42 times. The number of breakdown spots varying in size from 5–25 μm was then counted and expressed as "number of breakdown spots" per $cm^2$.

The photoconductor was charged to −500 volts and developed with the positively charged toner from a liquid developer head biased at −200 volts. Positively charged toner particles were attracted to the surface of the film. Clear circular spots called "dielectric breakdown" spots 5–25 μm in diameter appeared in regions deficient in surface charge and hence did not attract toner particles. The spots counted were about $3000/cm^2$. The photoconductor charged to −500 volts had a 1 v/sec dark decay. Photodischarge sensitivity from −500 volts to −250 volts required 4.5 $ergs/cm^2$ incident light at 640 nm.

EXAMPLE 2

A solution containing 8.10 gm of monomer 1, Table I, 0.324 gm of ethyl-p-dimethyaminobenzoate activator (EDAB) and 0.162 gm of 3-benzoyl-5,7-dipropoxycoumarin sensitizer (BDS) in 12.96 gm of 2-ethoxyethanol was prepared. This solution was coated onto a flexible, insulating polyester support which had previously been coated with a conductive layer of cuprous iodide. The coating was made by hand using a 25 μm coating knife. After evaporating the solvent, the monomer was crosslinked by UV irradiation with a 200 watt mercury lamp. The thickness of the thus formed barrier layer was 3 μm. The maximum electric field strength which can be applied across this layer under corona charging is $1.6\times10^6$ v/cm.

The photoconductive layer of Example 1 was coated on top of the barrier layer. This layer was 10 μm thick. At −500 volts, the density of dielectric breakdown spots was reduced to about $50/cm^2$ of photoconductive layer. The spots varied in size from about 5 to 20 μm. Photodischarge from −600 volts to −400 volts required 7.8 $ergs/cm^2$ of incident light at 640 nm.

EXAMPLE 3

A solution of 6.30 gm of monomer 1, Table I, 0.25 gm of EDAB, and 0.126 gm of BDS, in 11.7 gm of 2-ethoxyethanol was coated onto a flexible insulating polyester layer of cuprous iodide. After evaporating the solvent, the monomer was UV cured by irradiation with a 200 watt mercury lamp. This barrier layer had a thickness of 2 μm and the maximum electric field strength that could be applied across this layer under corona charging was $1.3\times10^6$ V/cm.

The photoconductive layer of Example 1 except for the addition of 0.010 gm of surfactant DC510® obtained from Dow Corning was coated on top of the barrier layer. This layer was 10 μm thick. At −500 volts, the density of dielectric breakdown spots was about $100/cm^2$ of the photoconductive layer. The spots varied in size from about 5 to 20 μm. The element had a dark decay of 2 v/sec. Photodischarge sensitivity from −500 volts to −250 volts required 10 $ergs/gm^2$ of incident light at 640 nm.

EXAMPLE 4

A solution of 6.3 gm of monomer 1, Table I, 0.25 gm of EDAB, 0.126 gm of BDS, and 0.018 gm of surfactant FC-431® obtained from the 3M Company in 11.7 gm of 2-ethoxyethanol was prepared and coated on a cuprous iodide conductive layer and dried as in Example 1. Thickness of this barrier layer was 4 μm; maximum electric field strength, $1.5\times10^6$ V/cm. Dielectric breakdown spots, were about $100/cm^2$ of photoconductor at −600 volts. The photoconductor layer was 12 μm thick and the same as in Example 1. Photodischarge sensitivity from −600 volts to −400 volts was 6.7 $ergs/cm^2$. Dark decay was 2.5 v/sec.

EXAMPLE 5

A solution of 6.3 gm of monomer 2, Table I, 0.25 gm of EDAB, and 0.126 gm of BDS in 16.5 gm of dichloromethane was prepared and then coated on the conductive layer of Example 1. The thickness of this barrier layer was 8 μm, with the photoconductive layer of Example 1 being 12 μm thick. The maximum electric field strength of the barrier layer was $1.4\times10^6$ V/cm. Dielectric breakdown spots were about 100/cm$^2$ at −600 volts. Photodischarge sensitivity from −600 volts to −400 volts was 14.9 ergs/cm$^2$. Dark decay was 2.5 v/sec.

EXAMPLE 6

A solution containing 6.3 gm of monomer 3, Table I, 0.25 gm of EDAB, and 0.126 gm of BDS in 16.5 gm of dichloromethane was prepared and coated as in Example 1. Thickness of this barrier layer was 7 μm. Maximum electric field strength was $1.5\times10^6$ V/cm at −600 volts. The photoconductive layer of Example 1 was 12 μm thick. Breakdown spots were about 100/cm$^2$ at −600 volts. Photodischarge sensitivity from −600 volts to −400 volts was 12.5 ergs/cm$^2$. Dark decay was 2 v/sec.

EXAMPLE 7 (Comparative Example)

This example demonstrates the relatively high density of dielectric breakdown spots with prior art cellulose nitrate barrier layers.

An electrographic coating composition was prepared as follows. A solution of 1.28 g of 2,6-diphenyl-4-(2,6-diphenyl-[4H]-thiopyran-4-ylidene methyl)thiopyrylium perchlorate, 1158 ml of dichloromethane, and 1 ml of hexafluoroisopropanol was prepared by stirring for two hours. Over a 1 hour period, 168 g of Lexan Bisphenol A polycarbonate was added. Then 91.8 g of tri-p-tolylamine was added over a 1-hour period, followed by 422 ml of toluene. The mixture was stirred in the dark for about 16 hours and hand-coated on a conductive support with a 150 μm coating knife to produce, upon drying, a 9 μm thick photoconductive layer.

The conducting support onto which this layer was applied was a poly(ethylene terephthalate) film support having first a layer of 92 weight percent cuprous iodide in 8 weight percent poly(vinyl formal) which was coated from acetonitrile (about 3% solids) to a dry coverage of about 25 to 30 mg/ft$^2$ (269 mg-323 mg/m$^2$); and a second layer of Hercules SS 5/6 sec. viscosity cellulose nitrate coated from about 20/80 by volume methanol/butanol solvent to a dry coverage of about 2 μm. The photoconductive layer was coated over the cellulose nitrate barrier layer.

At −500 V, the density of dielectric breakdown spots was about 1000/cm$^2$ of photoconductor. The spots varied in size from 5-25 μm. The photoconductor was charged to −500 V with a 2 v/sec. dark decay. Photodischarge from −500 V to −250 V required 10 erg/cm$^2$ incident light at 640 nm.

The foregoing examples show that the barrier layer used in the electrophotographic elements of this invention reduced dielectric breakdown spots significantly without any deleterious effect on the photodischarge sensitivity or the dark decay rate of such elements.

The invention has been described in detail with particular reference to preferred embodiments thereof, but it will be understood that variations and modifications can be effected within the spirit and scope of the invention.

We claim:

1. An electrophotographic element comprising a conductive layer, a organic photoconductive layer and a barrier layer between the conductive layer and the photoconductive layer characterized in that the barrier layer is capable of supporting an electric field in excess of $6\times10^5$ v/cm and comprises a polymerized crosslinked monomer having the structure

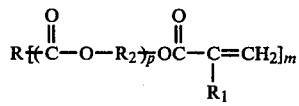

wherein

R 15 a cycloaliphatic or aromatic group;

$R_1$ 15 represents hydrogen or alkyl;

$R_2$ 15 alkylene of 1 to 20 carbon atoms, or $—CH_2CH_2(OCH_2CH_2)n$;

p is 0 or 1;

m is 1 to 6; and n is 1 to 20.

2. The electrophotographic element of claim 1, wherein the barrier layer comprises a polymerized crosslinked monomer having the formula:

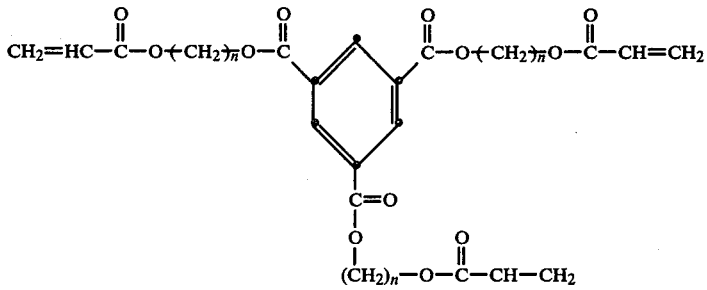

in which n is from 2 to 6.

3. The elements of claims 1 or 2 wherein the photoconductive layer comprises a bispyrylium dye and tri-p-tolylamine.

4. The elements of claims 1 or 2 wherein the conducting layer is selected from the group consisting of cuprous iodide, nickel and cermet.

* * * * *